US007242148B2

(12) United States Patent
Peng

(10) Patent No.: US 7,242,148 B2
(45) **Date of Patent: *Jul. 10, 2007**

(54) CONTINUOUS CURRENT CONTROL CIRCUIT MODULES OF SERIES STRING BULBS TYPE (II)

(76) Inventor: Mei-Ling Peng, 12F-1, No. 109, Sec. 3, Ho Ping East Road, Taipei City (TW)

( * ) Notice: Subject to any disclaimer, the term of this patent is extended or adjusted under 35 U.S.C. 154(b) by 0 days.

This patent is subject to a terminal disclaimer.

(21) Appl. No.: 11/062,835

(22) Filed: Feb. 23, 2005

(65) Prior Publication Data

US 2006/0197463 A1 Sep. 7, 2006

(51) Int. Cl.
*H05B 43/00* (2006.01)
*F21S 4/00* (2006.01)

(52) U.S. Cl. ..... 315/185 R; 315/185 S

(58) Field of Classification Search ..... 315/185 S, 315/185 R, 200, 312, 320, 324, 217; 362/800–812
See application file for complete search history.

(56) References Cited

U.S. PATENT DOCUMENTS 3,535,585 A * 10/1970 Barnum ..... 315/83
3,573,775 A * 4/1971 Zane ..... 340/594
3,639,805 A * 2/1972 Muench et al. ..... 315/122
3,778,676 A * 12/1973 Keller ..... 315/217
4,091,307 A * 5/1978 McNamara, Jr. ..... 315/92
4,727,449 A * 2/1988 Fleck ..... 361/54
5,504,396 A * 4/1996 Fowers ..... 315/121
5,598,068 A * 1/1997 Shirai ..... 315/185 R
5,731,667 A * 3/1998 Luchetta et al. ..... 315/323
5,886,423 A * 3/1999 Gershen et al. ..... 307/36
6,084,357 A * 7/2000 Janning ..... 315/122
6,396,219 B1 * 5/2002 Tang ..... 315/185 S
6,956,338 B1 * 10/2005 Clark et al. ..... 315/312

* cited by examiner

*Primary Examiner*—Don Wong
*Assistant Examiner*—Hung Tran Vy
(74) *Attorney, Agent, or Firm*—Rosenberg, Klein & Lee

(57) ABSTRACT

The invention relates to a continuous current control circuit module of series string bulbs type (II), which can maintain the normal current and voltage across each of the bulbs when any of series connected bulbs burn out. The string includes a shunt in every bulb assemblies, which has an auxiliary conductive apparatus including an SCR (silicon controlled rectifier), a TRIAC (THYristor), a DIAC (trigger diode), or a Transistor with resistors and is parallel connecting related to the bulb. The shunt will thus provide a secure electrical connection of the light string whenever any bulb is burn out or broken.

3 Claims, 14 Drawing Sheets

CONTINUOUS CURRENT CONTROL CIRCUIT MODULES OF SERIES STRING BULBS TYPE (II)

FIELD OF THE INVENTION

The present invention relates to an improvement of a continuous current control circuit module of series string bulbs, which includes a secure shunt for maintaining electrical connection of the light string effectively.

BACKGROUND OF THE INVENTION

In prior art, continuous current control circuit modules of series string bulbs in order to maintain their electrical connection whenever any bulb assembly is broken or loosen have different structures. One is to provide an elastic metal slice in every bulb assembly being parallel connected to the bulb. If the bulb is broken, the metal slice becomes a shunt for connecting the series connected light string. Another design, in U.S. Pat. No. 6,084,357, discloses a string in which all of the bulb filaments in the set are individually provided with a non-avalanche shunt circuit to replace the elastic metal slice. The shunt circuit includes two or more silicon diodes. Since the diode is directional, it must be connected in correct direction. If there is any mistake in connection, the shunt will be out of work. Moreover, when the diode is used, the temperature will be increased rapidly to about centigrade 64 degree, that could cause the solved of the holder of the bulb and even leads a fire danger. There is an improvement by inventor of this application, which uses a triode to replace the known diode that overcomes the drawback in prior art.

SUMMARY OF THE INVENTION

The present invention is to provide a further improved continuous current control circuit module of series string bulbs having secure shunt, which includes an auxiliary conductive apparatus in each circuit module. Now, accompanying with the following drawings, the character of the present invention will be described here and after.

BRIEF DESCRIPTION OF THE DRAWINGS

FIG. 2-1 is a schematic view showing a first embodiment of an electrical circuit according to the present invention.

FIG. 2-2 is a schematic view showing a modified electrical circuit of FIG. 2-1.

FIG. 2-3 is a schematic view showing another modified electrical circuit of FIG. 2-1.

FIG. 3-1 is a schematic view showing a second embodiment of an electrical circuit according to the present invention.

FIG. 3-2 is a schematic view showing a modllled electrical circuit of FIG. 3-1, FIG. 3-3 is a schematic view showing another modified electrical circuit of FIG. 3-1

FIG. 3-4 is a schematic view showing vet another modified electrical circuit of FIG. 3-1.

FIG. 4-1 is a schematic view showing a third embodiment of an electrical circuit according to the present invention.

FIG. 4-2 is a schematic view showing a modified electrical circuit of FIG. 4-1.

FIG. 4-3 is a schematic view showing another modified electrical circuit of FIG. 4-1.

FIG. 5-1 is a schematic view showing a fourth embodiment of an electrical circuit according to the present invention.

FIG. 5-2 is a schematic view showing a modified electrical circuit of FIG. 5-1.

FIG. 5-3 is a schematic view showing another modified electrical circuit of FIG. 5-1.

DETAILED DESCRIPTION OF THE PREFERRED EMBODIMENT

Figure 1:
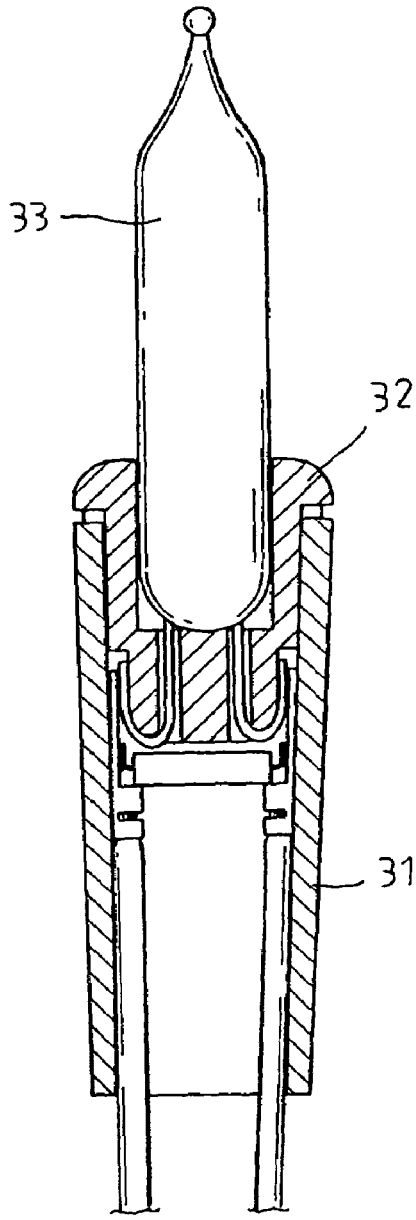
FIG. 1 is a cross-sectional plan view showing a bulb assembly according to the present invention.
Figures 1, 2:
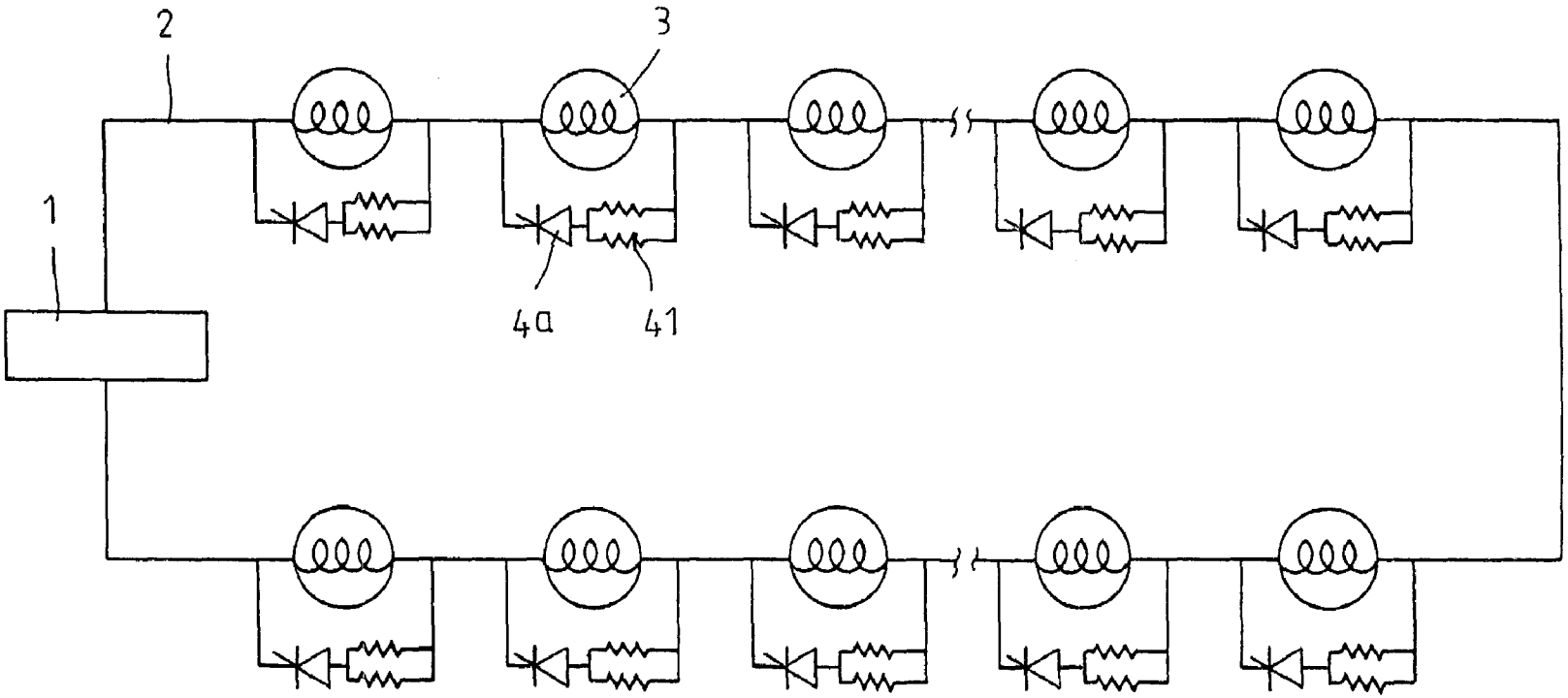
Figure 2:
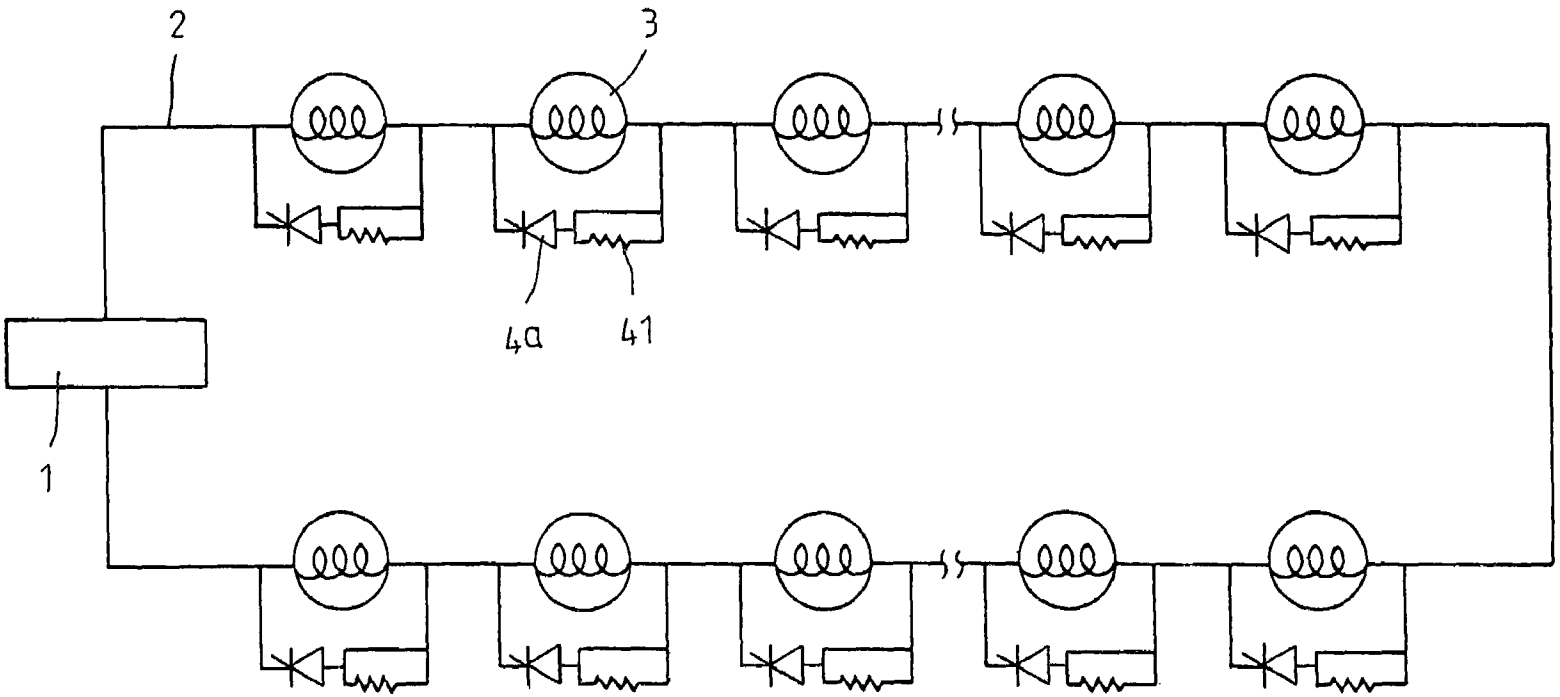
Figures 2, 3:
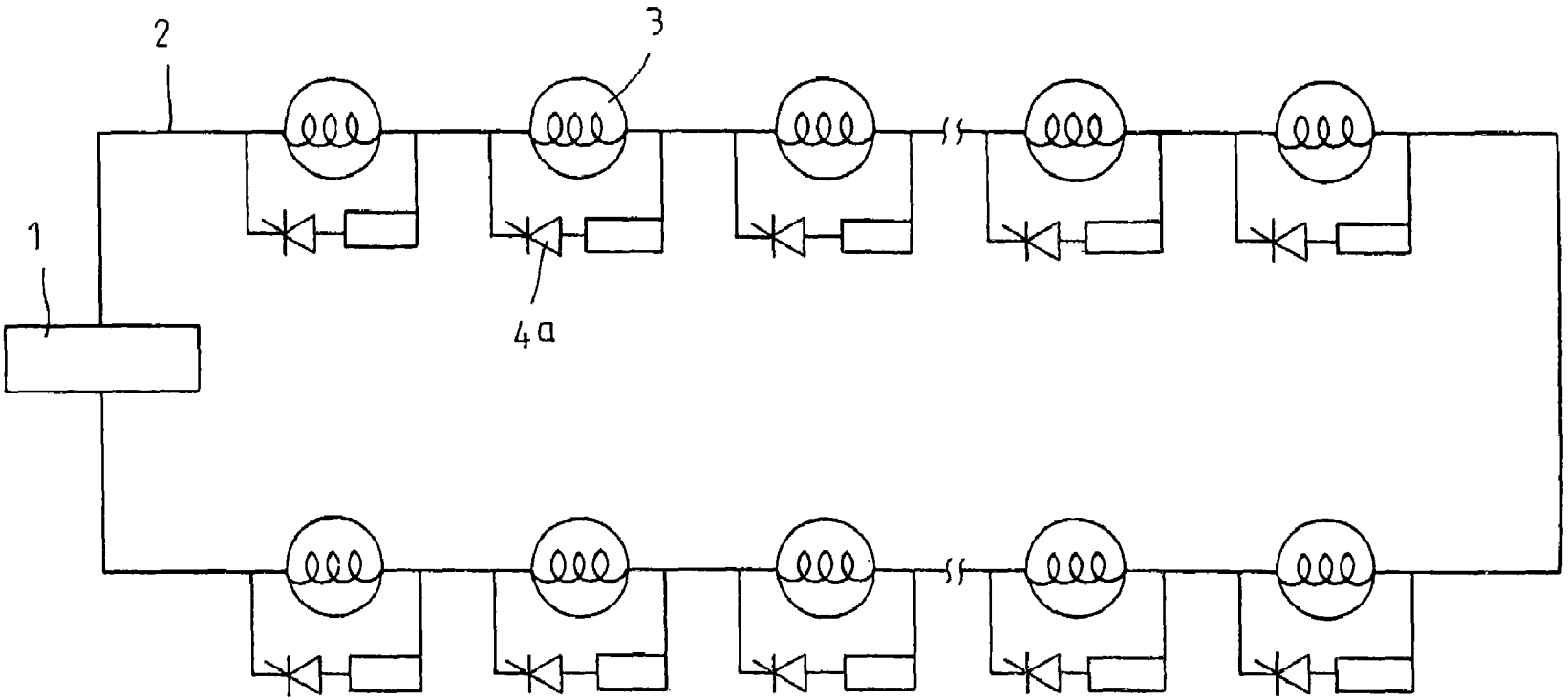
Figures 1, 3:
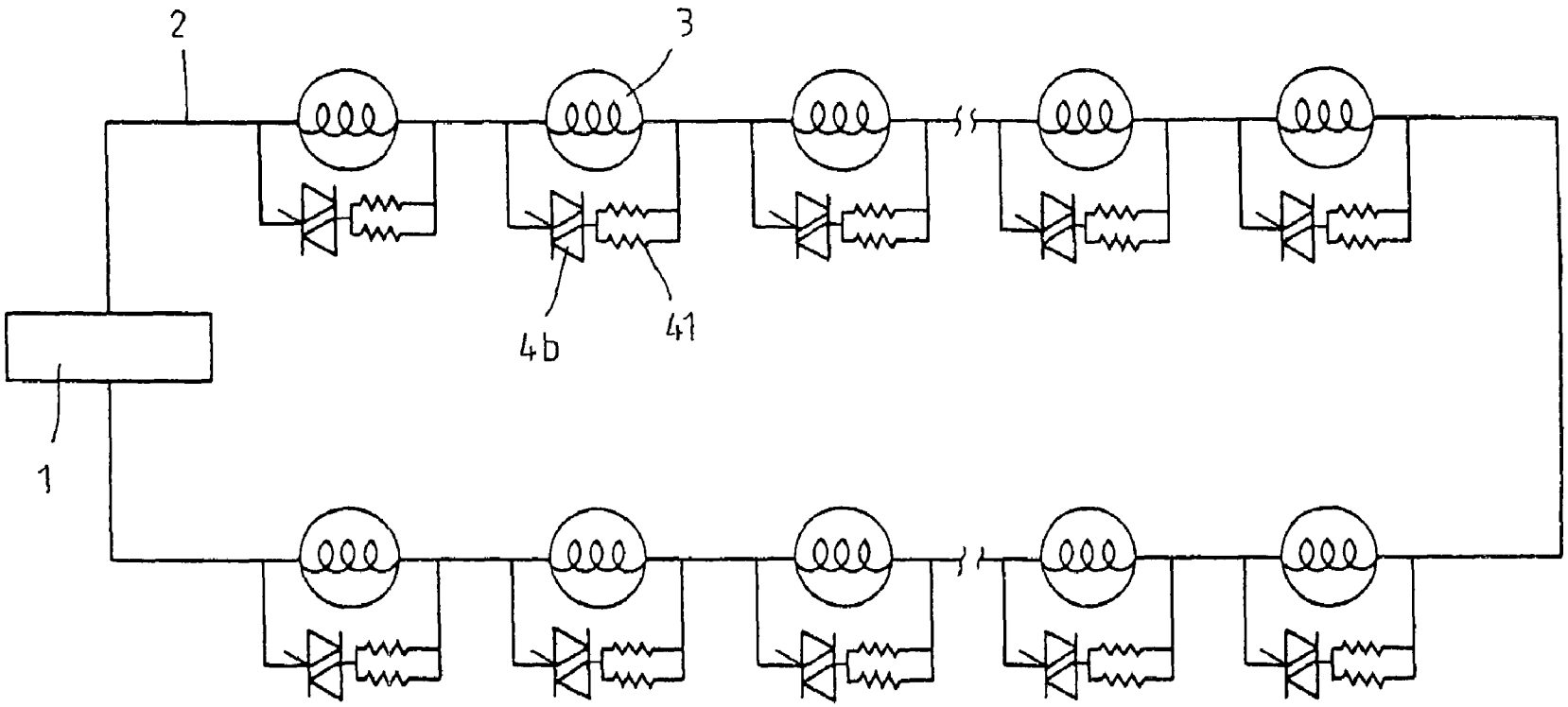
Figures 2, 3:
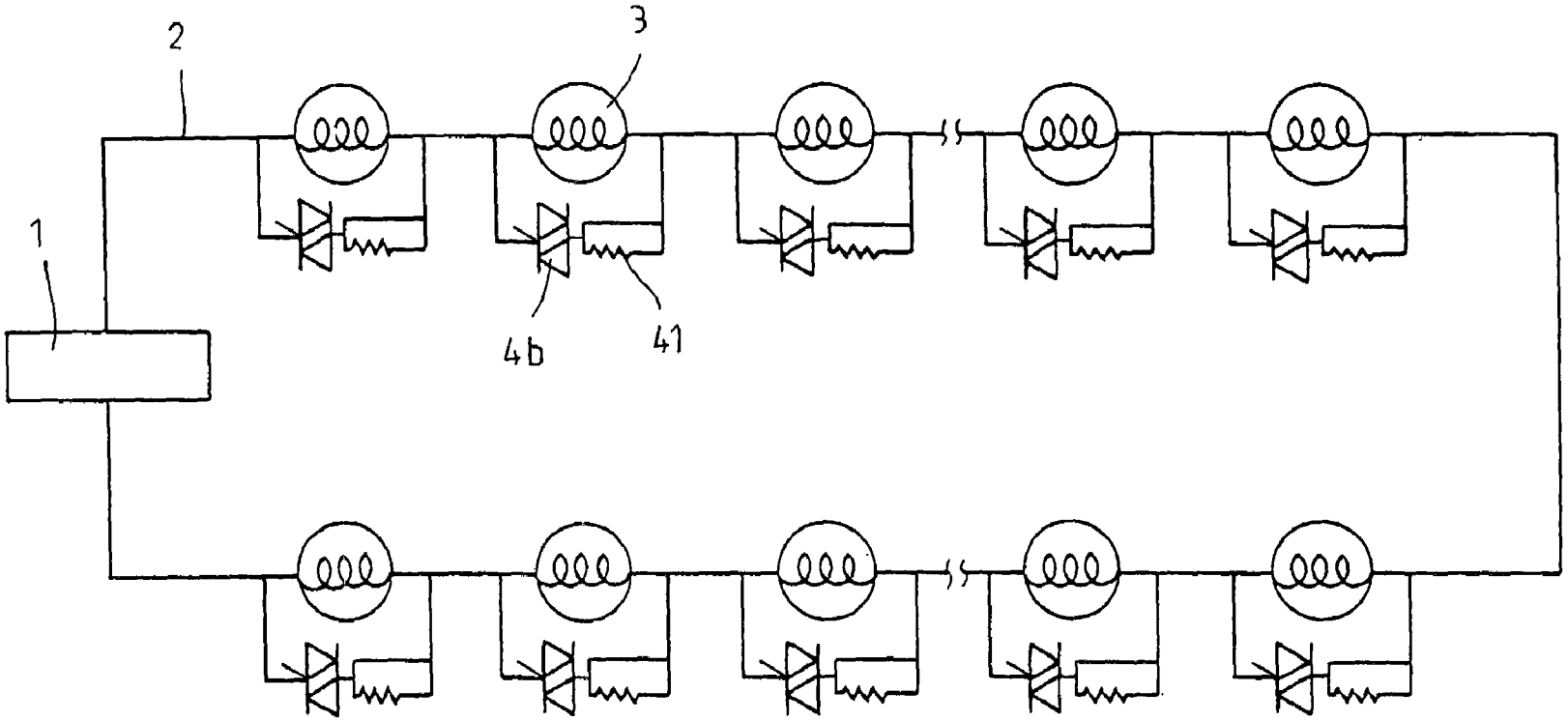
Figure 3:
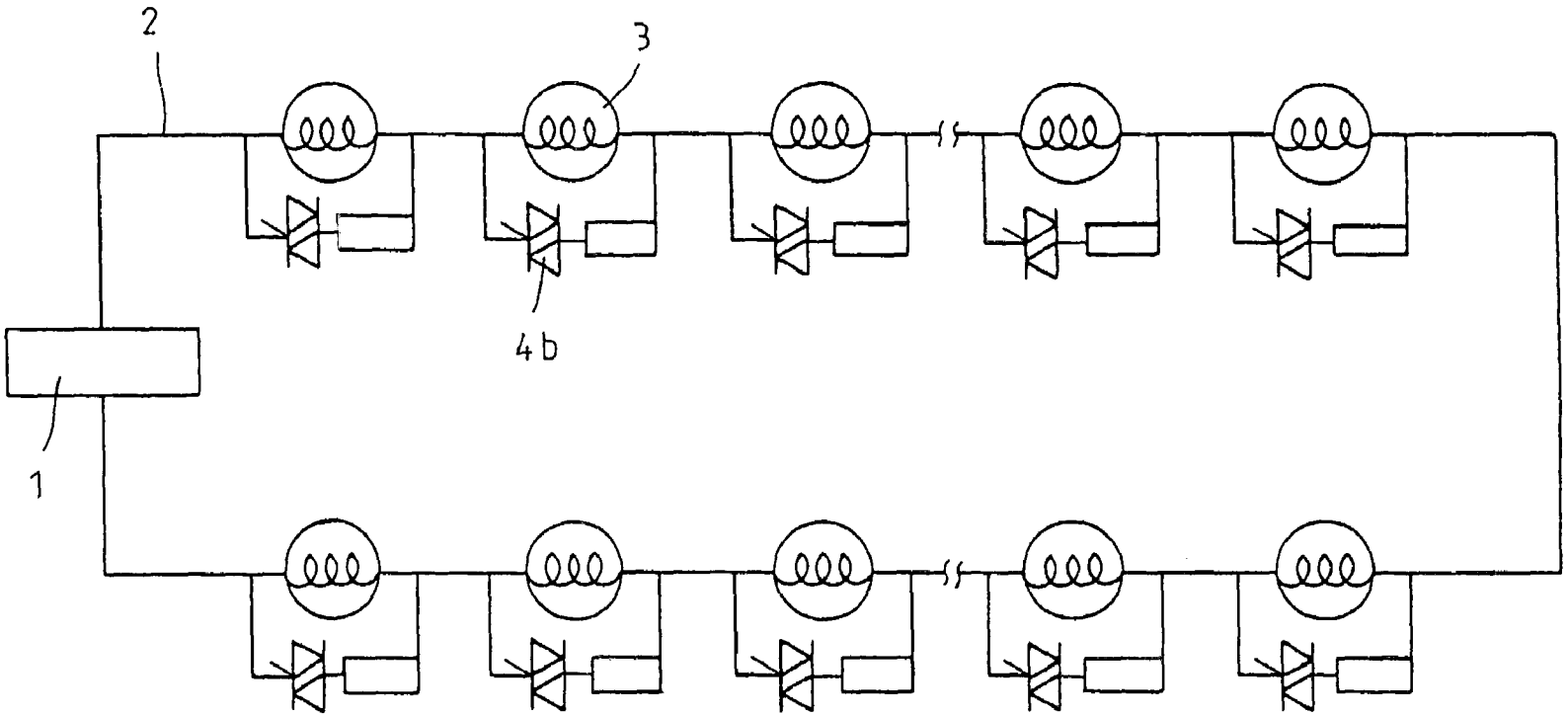
Figures 3, 4:
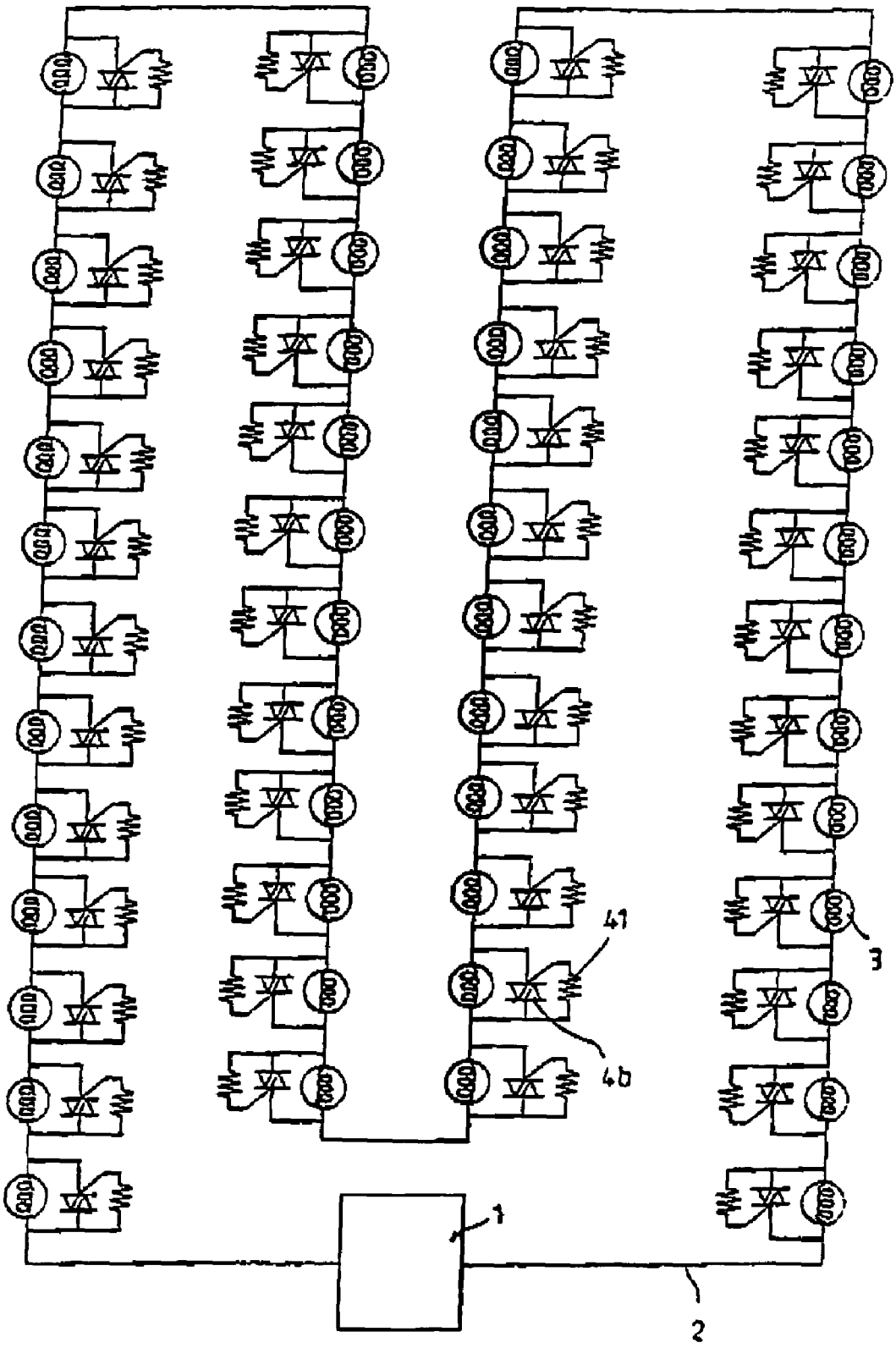
Figures 1, 4:
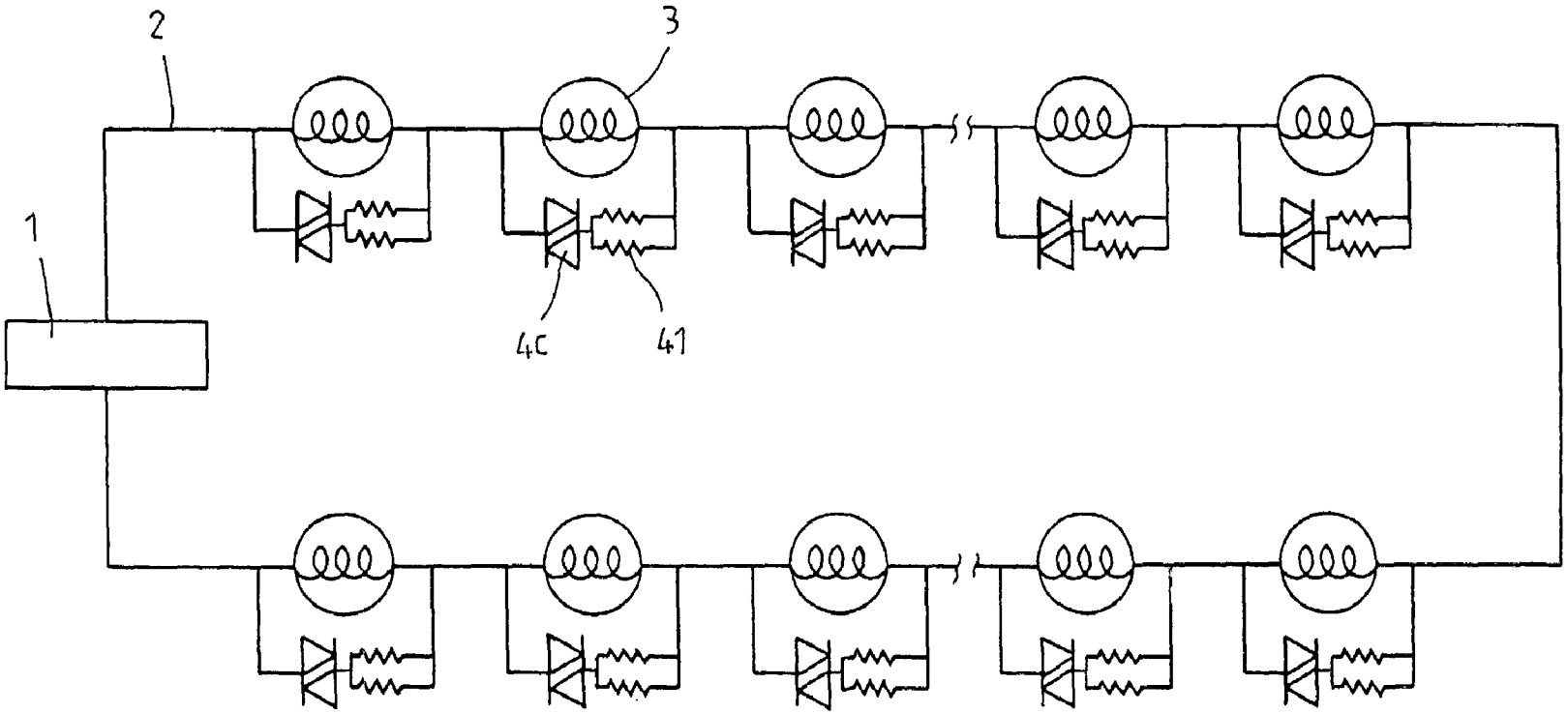
Figures 2, 4:
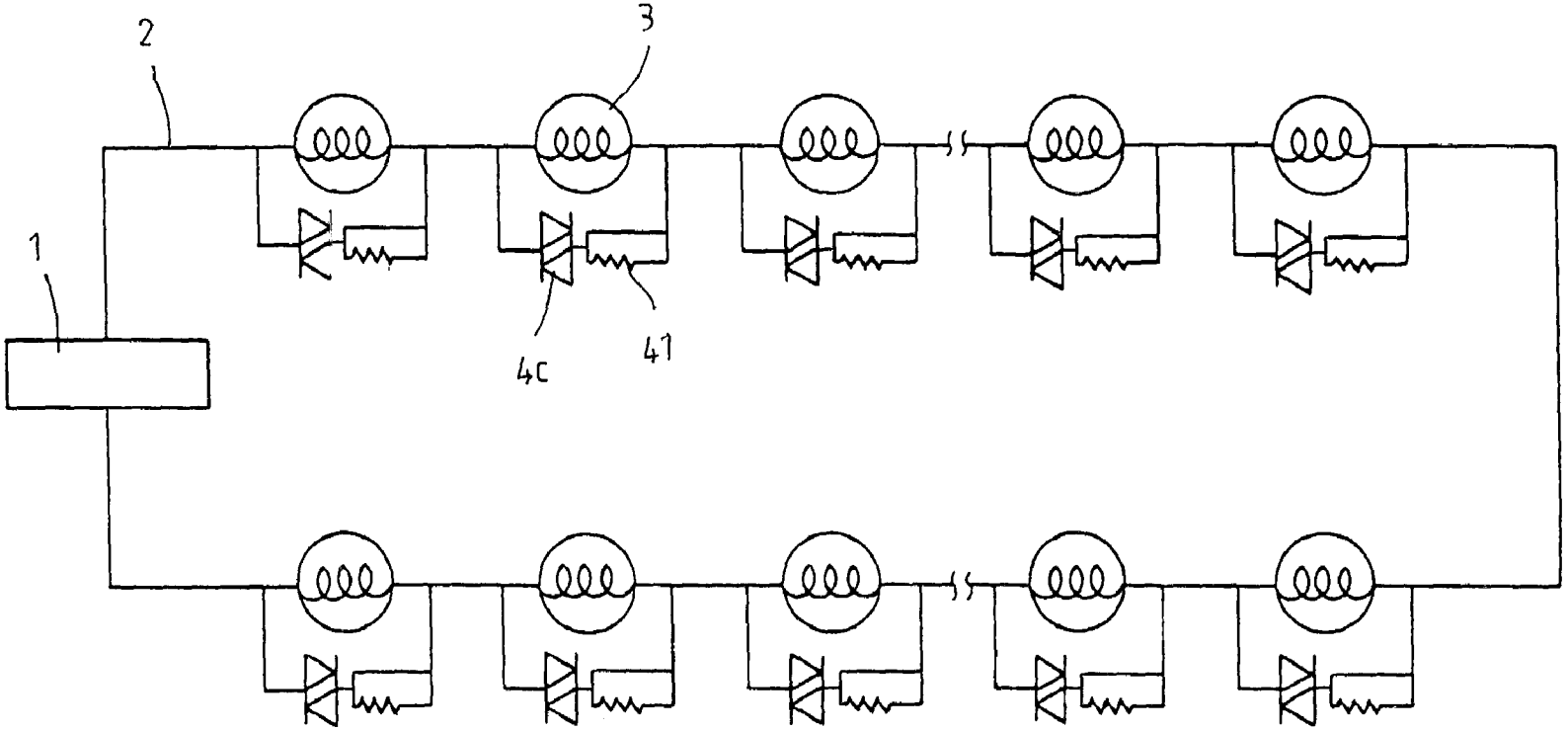
Figures 3, 4:
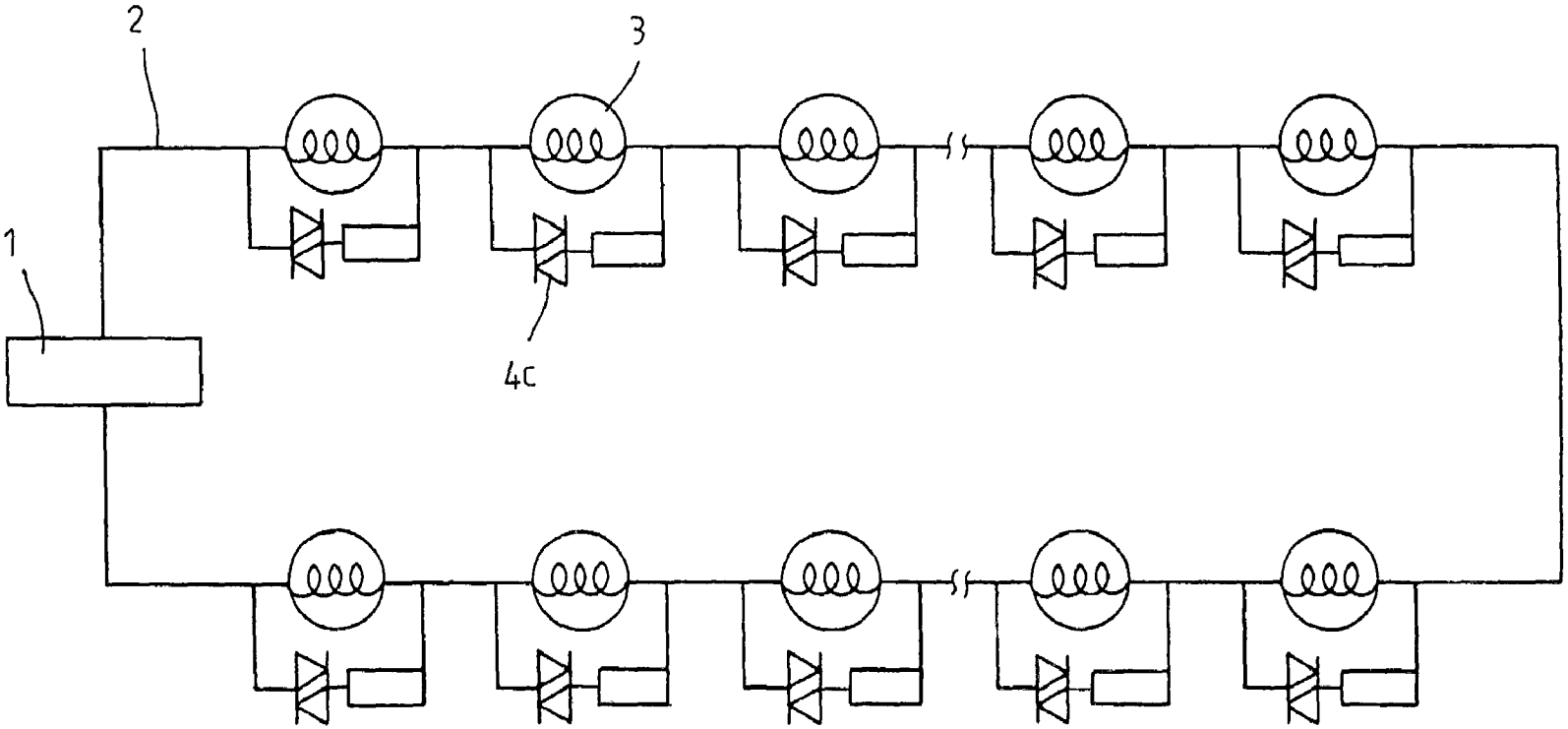
Figures 1, 5:
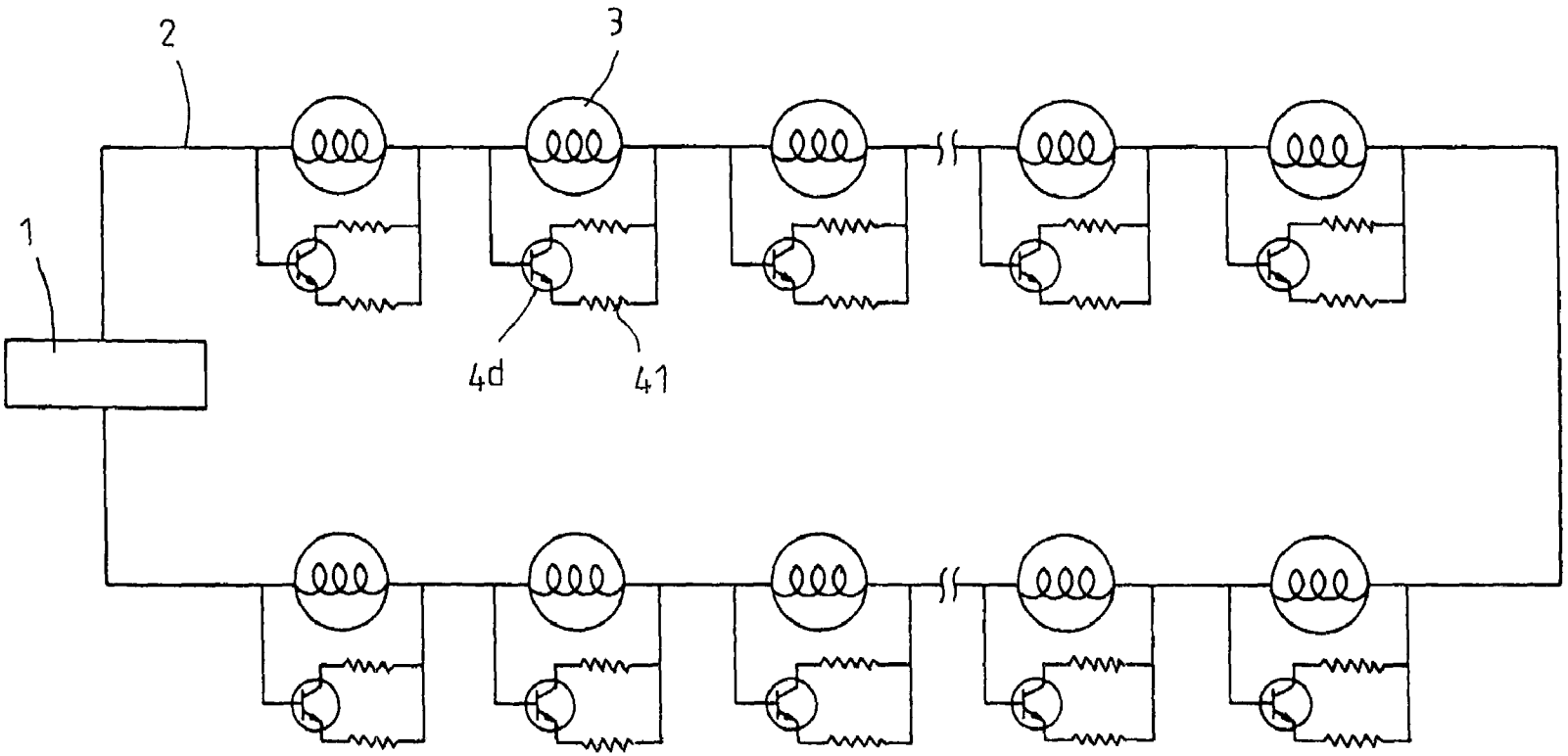
Figures 2, 5:
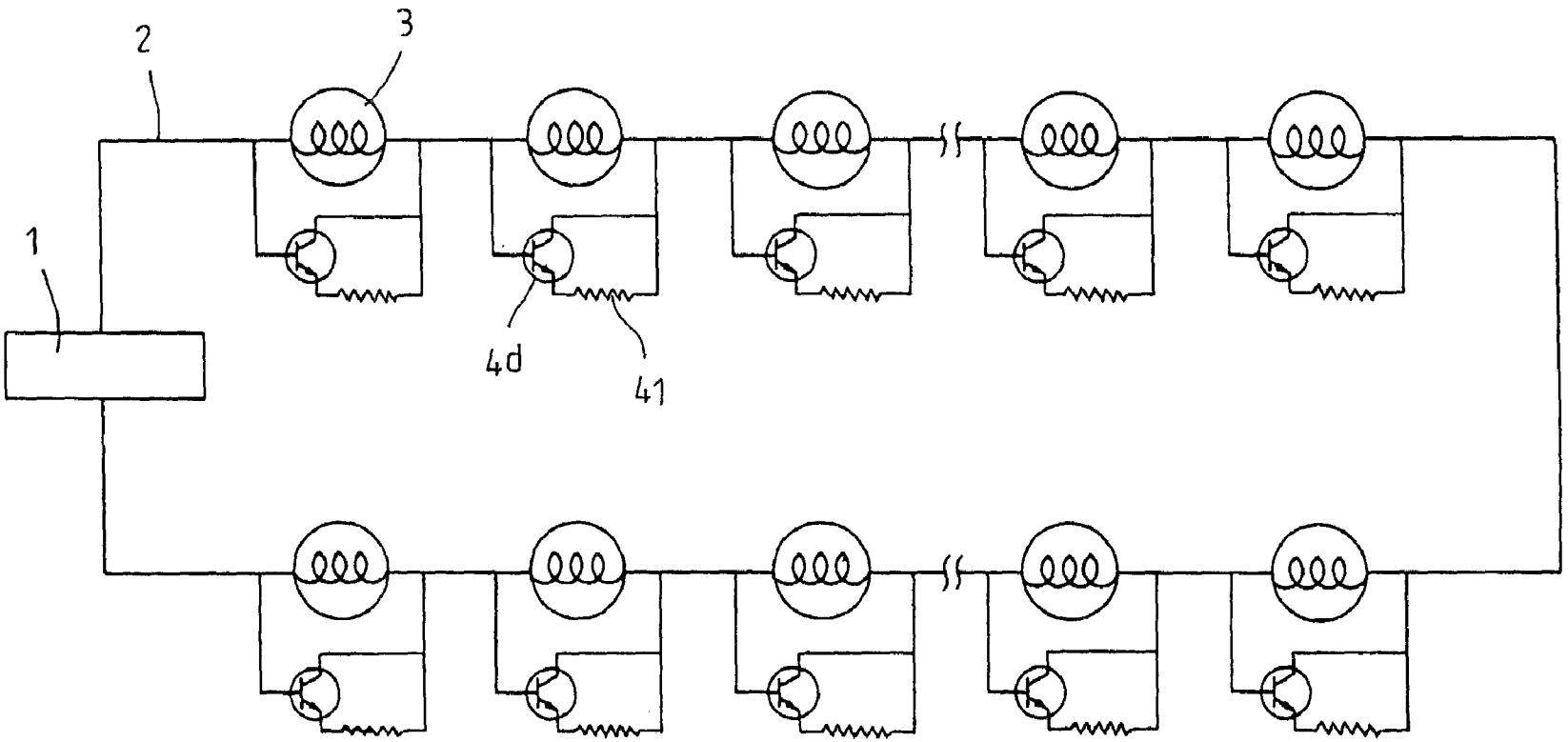
Figures 3, 5:
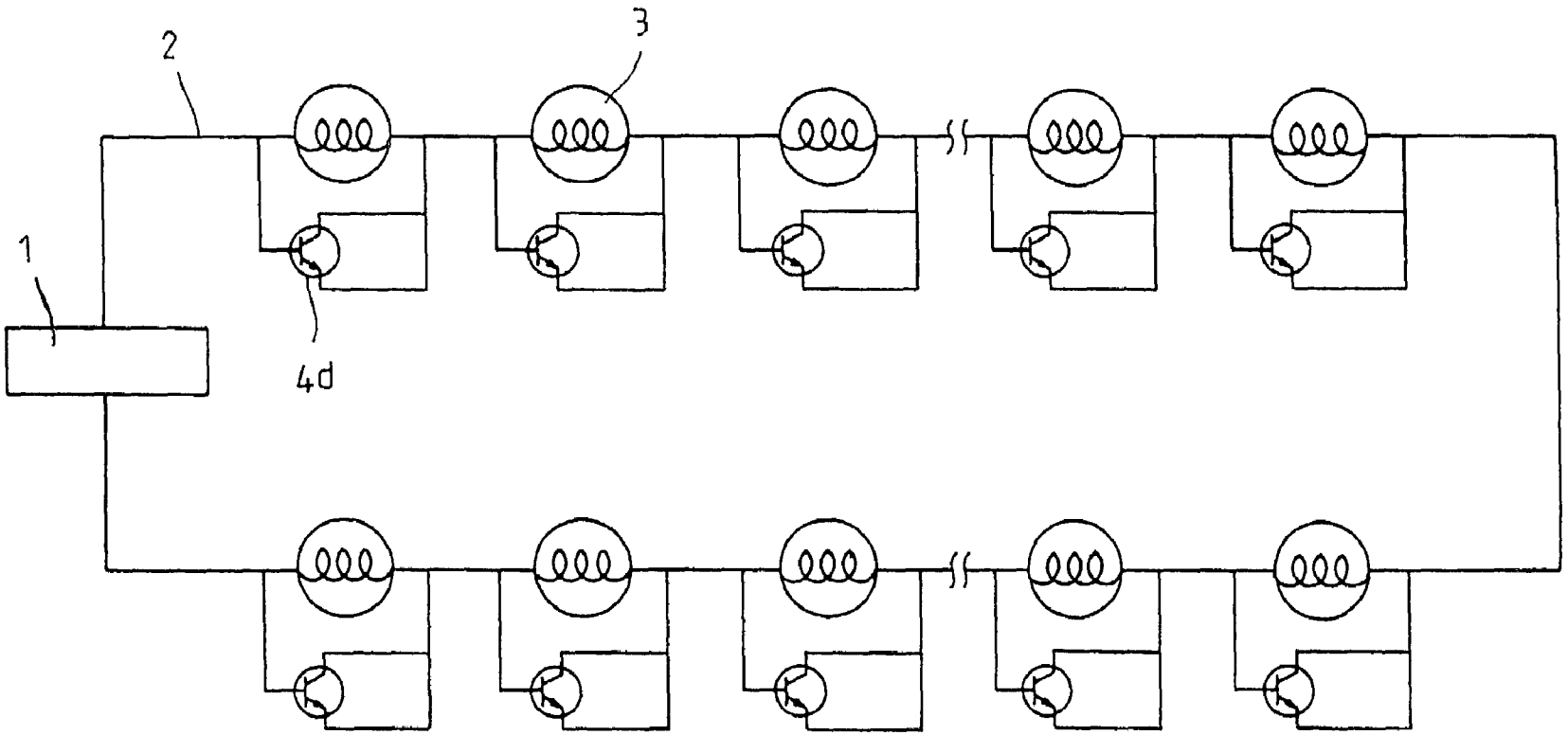

Please refer to FIGS. 2-1, 3-1, 4-1, and 5-1, the present invention relates to an improvement of a continuous current control circuit module of series string bulbs, which includes a power source (1) and a main electrical wire (2) connecting with many bulb assemblies (3), such as 50 sets or 100 sets. Each bulb assembly (3) includes a shell (31), a bulb holder (32), and a bulb (33), as shown in FIG. 1. The improvement of the present invention is to provide a secure shunt having an auxiliary conductive apparatus including a SCR (silicon controlled rectifier) (4*a*), TRIAC (THYristor) (4*b*), DIAC (trigger diode) (4*c*), or Transistor (4*d*) to connect within the bulb assembly (3) in parallel to the bulb (33). Further, two resistors (41) are capable to be connected in the secure shunt that provides a resistance slightly higher than the resistance of the bulb (33).

In use, the auxiliary conductive apparatus in the shunt provides an effective electrical connection for the series connected light string. When the bulb (33) is used in normal, the string works normally. If the bulb (33) is burn out or broken, either one of the auxiliary conductive apparatus keeps the circuit in electrical connection through the shunt and maintains the series connected light string worked normally as usual. At the same time, in accompany with the effect of the auxiliary conductive apparatus, the bulb assembly (3) remains a low temperature, up to centigrade 42 degree, that prevents the drawback of the said conventional art.

In above application, the shunt includes two resistors (41) is only an exemplary. In fact, one resistor (FIG. 2-2, 3-2, 4-2, or 5-2) or none resistor (FIG. 2-3, 3-3, 4-3, or 5-3) is available in the shunt of the present invention, which can obtain the predicted purpose as above description and is better than ever.

I claim:

1. A continuous current control circuit module of series string bulbs including a power source and a main electrical wire connecting with a plurality of bulb assemblies, wherein each bulb assembly includes a shell, a bulb holder, and a bulb; the improvement comprising: a secure shunt in each bulb assembly having an auxiliary conductive apparatus for standby operation responsive to bulb failure including a TRIAC (THYristor) provided to connect bi-directionally within the bulb assembly in parallel to the bulb, and at least one resistor connected in the secure shunt that provides a resistance substantially equivalent in value to the resistance of the bulb.

2. A continuous current control circuit module of series string bulbs as claimed in claim 1, wherein the secure shunt includes an auxiliary conductive apparatus and only one resistor.

3. A continuous current control circuit module of series string bulbs as claimed in claim 1, wherein the secure shunt includes a plurality of resistors coupled to the TRIAC.

* * * * *